United States Patent [19]

Fedder

[11] 4,452,174

[45] Jun. 5, 1984

[54] TONER CONCENTRATION SENSOR ASSEMBLY FOR ELECTRO-PHOTOGRAPHIC APPARATUS

[76] Inventor: Richard C. Fedder, 106 Eastern Fork, Longwood, Fla. 32750

[21] Appl. No.: 525,259

[22] Filed: Aug. 22, 1983

Related U.S. Application Data

[63] Continuation-in-part of Ser. No. 429,861, Sep. 30, 1982, abandoned.

[51] Int. Cl.[3] ..... G03G 15/09

[52] U.S. Cl. ..... 118/689; 222/57; 324/236; 355/3 DD

[58] Field of Search ..... 118/689, 690; 222/DIG. 1, 57; 324/236; 355/3 DD

[56] References Cited

U.S. PATENT DOCUMENTS 3,970,036 7/1976 Baer et al. ..... 118/689

4,208,985 6/1980 Anzai et al. ..... 118/689 X

*Primary Examiner*—Evan K. Lawrence

*Attorney, Agent, or Firm*—Carl Fissell, Jr.; Edmund M. Chung; Kevin R. Peterson

[57] ABSTRACT

A toner concentration sensor assembly wherein a toner cartridge carrying a fresh supply of toner material is demountably insertable into the assembly so as to bring the fresh toner into the original developer mix and wherein a portion of developer mix is metered off the magnetic brush application roller of the apparatus into an inductor surrounding a chute-like, open ended cannister. An electromagnet is used to close the chute by immobilizing the developer mix within the chute while a signal output is taken from the inductance and applied to a sensing circuit to determine the quantity of toner to stabilize the mix concentration to a predetermined level for copy printing output. An interconnected mechanism operably associated with the toner cartridge replenishes the toner on command from the system software as a result of a comparison between toner concentration levels and a preset concentration required for clear, clean, crisp printing/copying.

8 Claims, 13 Drawing Figures

FIG. 2.
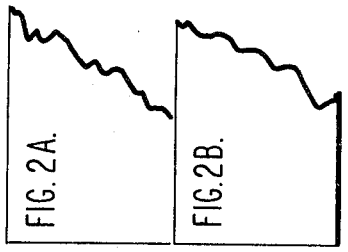
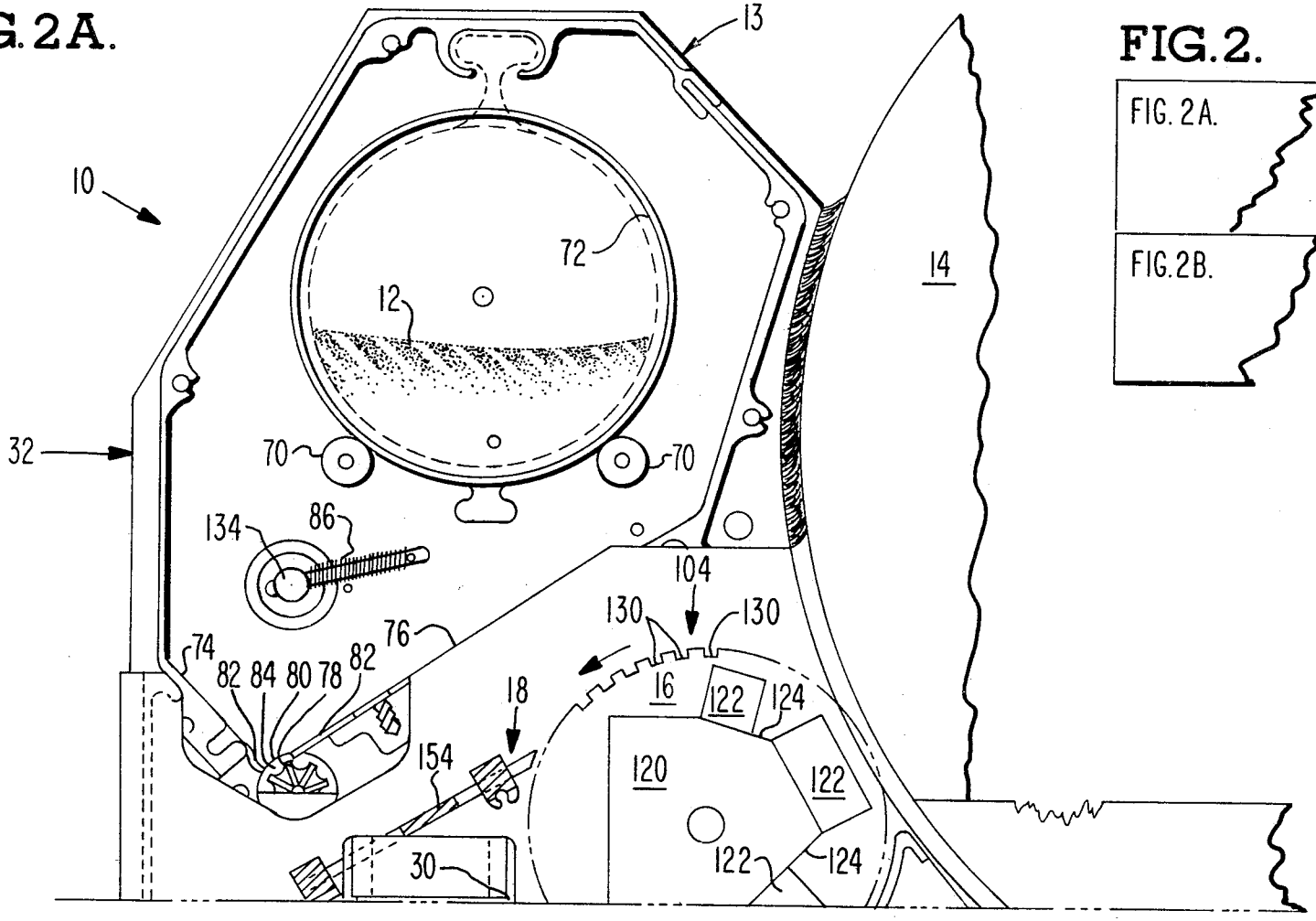
FIG. 2A.

14
20
30
34
36
38
40
42
43
44
46
48
50
52
54
56
60
62
64
66
68
81
88
90
92
96
98
100
122
124
148
150

32
144
142
146
140
134
136
156
158
178
180
108
174
170

TONER CONCENTRATION SENSOR ASSEMBLY FOR ELECTRO-PHOTOGRAPHIC APPARATUS

This application is a continuation-in-part of application Ser. No. 429,861, filed Sept. 30, 1982 abandoned.

BACKGROUND OF THE INVENTION

1. Field of the Invention

The present invention relates broadly to electrophotographic apparatus utilizing a multicomponent developer and more particularly to means for automatically controlling the concentration of the components of the developer during operation of the apparatus.

2. Background of the Invention

Many prior art devices and apparatus have been employed in the past and some are still in use for detecting toner concentration so as to maintain the resulting copy uniform as to density and definition.

In one arrangement a pair of opposing glass plates provided with facing metallized surface is arranged so that toner passes between the plates which are electrically charged. The charge causes the toner to be attracted to the plates. An optical sensor, causes light to pass through the plates, the amount of toner being sensed is proportional to the amount of light received by the sensor-receptor. The sensitivity of this type of device is fairly low, however, and detection is performed on the fly i.e. as the toner is passing between the plates.

Still another apparatus employs "white" carrier beads with an optical sensor. The amount of "white" light reflected to the receptor varies with the amount of toner thereby enbling a determination to be made as to the concentration of the toner in the apparatus.

Each of the known types of toner concentration sensing devices is useful to a more or less limited degree but no single device provides completely adequate and efficient signal output to prevent deterioration of the output copy for one reason or another. Thus, none of the prior art apparatus is capable of performing completely efficiently and adequately to provide copy whose density, definition and clarity remains constant throughout its period of use.

SUMMARY OF THE INVENTION

In order to maintain the optical density of the output copy constant it is necessary to control the toner concentration in a printer or copier which is utilized as a high output device. For this reason many low volume copiers do not require automatic density control since the number of copies per day is sufficiently small that toner can be added manually by the operator, as needed. However, high volume printer/copiers must operate more or less continuously and substantially unattended and therefore require some means for automatic control of the toner concentration. The present invention provides a simple, fairly low cost, efficient and reliable means for controlling the toner concentration so as to provide a clean, clear, crisp, uniformly dense output copy.

Studies have shown that the permeability of the developer mix changes with toner concentration with a higher permeability at lower toner concentration. This effect results from use of a two component developer comprising a mixture of magnetic ferrite or steel carrier beads together with nonmagnetic toner particles. It is well known in the art of electrophotography that the toner particles and carrier beads take on the opposite sign of triboelectric charge when the mix is mechanically agitated. For example, the toner particles may become charged negatively due to rubbing against the carrier beads while the carrier beads become positively charged.

After a certain amount of mixing each carrier bead has many of the smaller negatively charged toner particles clinging to the surface of the bead. This coating of toner particles keeps the carrier beads slightly separated in the mix. With fewer toner particles on each carrier bead, the beads can come into closer proximity. In the extreme case when the toner concentration is zero the carrier beads will come into direct contact with each other.

A variation in permeability is associated with the variation and separation of the carrier beads. Thus, when no toner is present while in a magnetic field, the carrier beads will hang together in a chain with no toner particles therebetween. The permeability along such a chain will be relatively high. Conversely, when toner particles are introduced into the mix the carrier beads will be separated somewhat by the toner particles. Thus, the permeability of the chain will be lower because of the intervening toner particles.

The present invention takes advantage of the foregoing phenomenon in solving these and other problems associated with toner sensing by providing a modular, demountable, toner concentration sensor assembly wherein a toner cartridge carrying a fresh supply of toner material is demountably insertable into the assembly so as to bring the fresh toner into the original developer mix and wherein a portion of developer mix is metered off the magnetic brush or application roller of the apparatus into an inductor surrounding a chute-like, open ended cannister. An electromagnet is used to close the chute by immobilizing the developer mix within the chute while a signal output is taken from the inductance and applied to a sensing circuit to determine the quantity of toner to stabilize the mix concentration or bring the concentration to a predetermined level for copy printing output. An interconnected mechanism operably associated with the toner cartridge replenishes the toner on command from the system software as a result of a comparison between toner concentration levels and a preset concentration required for clear, clean, crisp printing/copying.

BRIEF DESCRIPTION OF THE DRAWINGS

FIG. 2 is a chart showing how FIGS. 2A and 2B are to be joined to provide a side elevational view of the present invention;

FIG. 2A is a side elevational view of the toner hopper unit of the present invention as embodied in a printer/-copier apparatus;

FIG. 2B is a side elevational view of the developer unit of the present invention;

FIG. 2C is a detail edge view of the tilt-latch of the present invention;

FIG. 3A is a front elevational view of the toner hopper;

FIG. 3B is a front elevational view of the toner mixer unit including the main drive train;

DESCRIPTION OF THE PREFERRED EMBODIMENT

Figure 1:
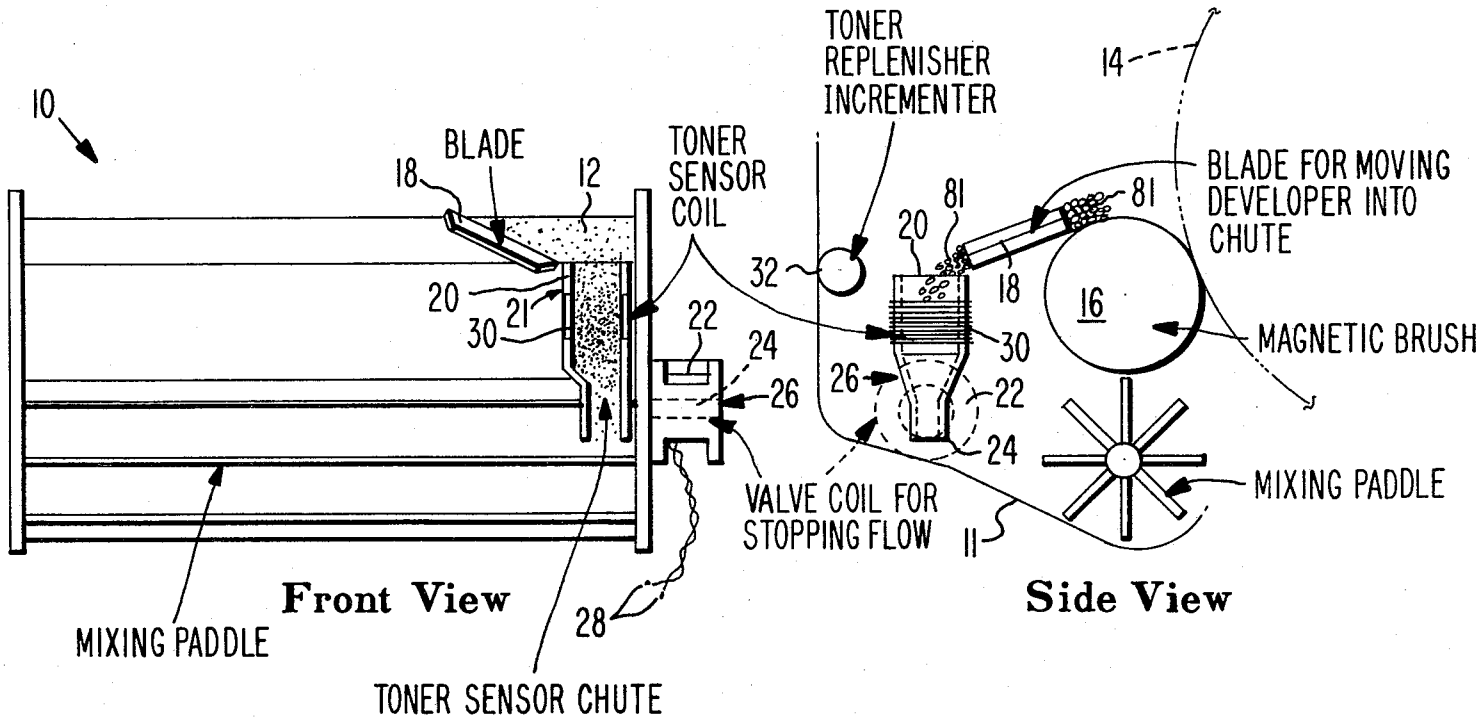
FIG. 1 is a highly schematic illustration of apparatus embodying the present invention.

The schematic diagram of FIG. 1 illustrates the toner sensor mechanism of the present invention operably associated with a demountable, toner hopper-developer modular assembly 10. As shown, used developer mix 81 coming off the top of the magnetic brush 16 after toning photoreceptor drum 14 is scraped off the magnetic brush roller 16 by a doctor blade 18. Part (a relatively small portion) of the total mix 12 is directed by the doctor blade 18 into a toner-sensor chute 20 of a toner concentration sensor assembly 21.

Figure 6:
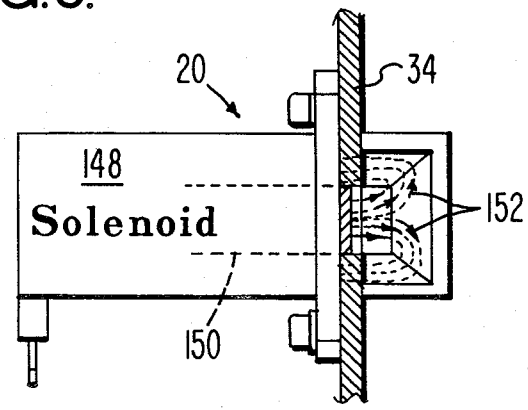
FIG. 6 is a top plan view of the apparatus of FIG. 5.
Figure 5:
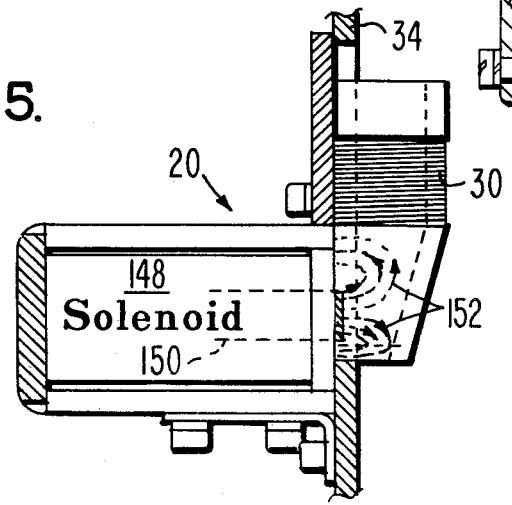
FIG. 5 is a rear elevational view of the toner sensor chute.
Figure 8:
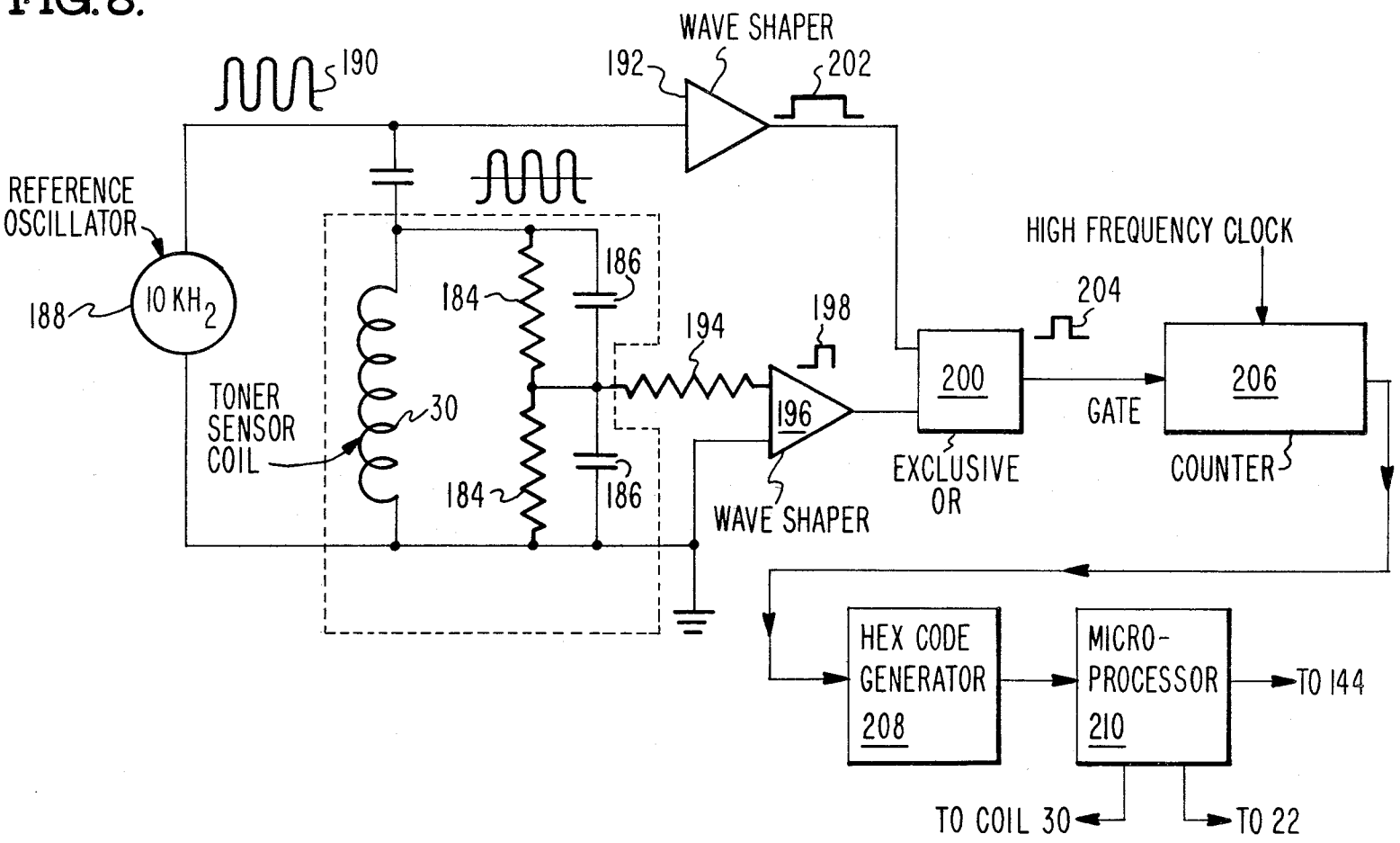
FIG. 8 is a schematic diagram of an electrical circuit used with the present invention.

Energization of a valve coil 22 surrounding the core 24 of solenoid 26 (over lines 28) causes a magnetic field FIGS. 5 and 6 to be developed near the tip of the coil core 24 which immobilizes the incoming developer, momentarily compacting it within the chute and preventing any developer flow-through. Once the developer 12 has filled the chute 20, a toner sensing coil 30 surrounding the upper portion of the chute 20 is energized from a sensing circuit (FIG. 8). The inductance of the sensor coil 30 now depends upon the permeability of the developer mix 12 and hence of the toner concentration in the mix 12. After the measurement has been made the valve coil 22 is de-energized whereupon the developer mix 12 drops or falls into the main hopper, 11 for reuse. Obviously, the level of developer in the main hopper, 11, must be sufficiently low relative to the chute bottom to ensure free flow of the developer out of the bottom of the chute 20.

Figures 2B, 2C:
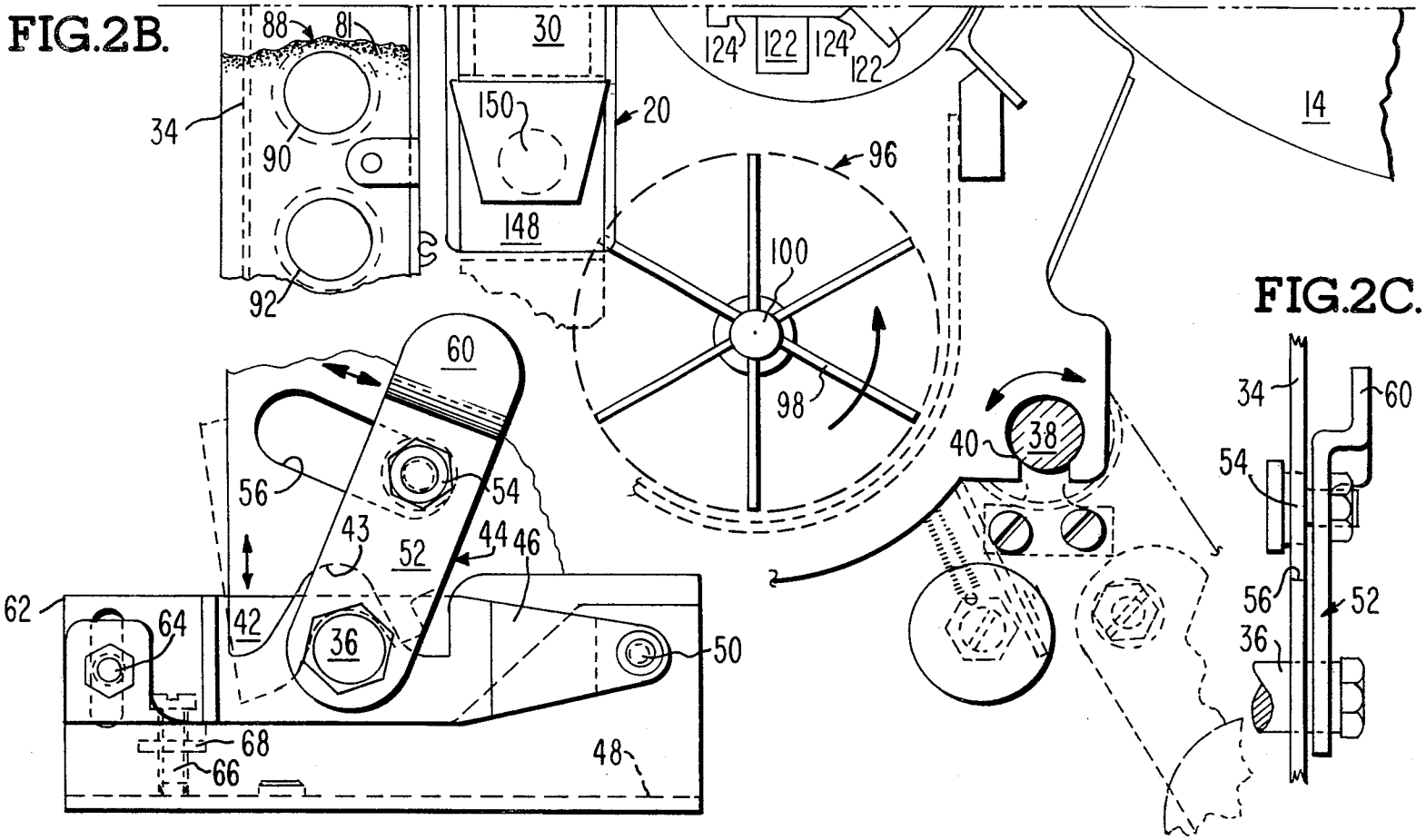

The developer unit with the toner concentration sensor assembly as used in electrophotographic printing/copying apparatus and in accordance with the teaching of the present invention is structurally illustrated in one or more of the drawings (FIGS. 2A and 2B) and is seen in FIGS. 2A and 2B to comprise a rectangular, demountable, slideably movable, modular assembly 10.

Oppositely disposed, upper and lower, rigid side plates 32—32 and 34—34, respectively, support various parts of the modular asembly 10 which is slideably mounted on left and right hand guide rods 36 and 38, respectively.

Integral, circular guides 40 (rear guide not shown) on the right side of each vertical wall member 34—34 together with the circularly notched lower left guide 42 support and restrain the assembly 10.

In order to mount the developer module 10 adjacent to the drum 14 without touching the drum and so that no accidental contact is made during movement of the module 10 a novel module "tilt-latch" assembly 44 is provided (bottom left FIG. 2B).

An elongated, irregularly shaped horizontal link 46, pivoted to the main frame 48 by means of pin 50, carries a vertically disposed, latch member 52 rockable about guide rod shaft 36. A nylon roller 54 deposed intermediately between ends of latch 52 is adapted to ride in the aperture 56 in the lower left portion of side plate 34. The rightward end of notch 56 is provided with an enlarged radius 58 for purposes to be described shortly. The extreme upper end 60 of latch 52 is bent out of the main plane of this member to provide finger clearance for the operator (FIG. 2C).

The left end of link 46 is bent out of the main plane of this member 50 so as to clear the lower member 42 and is provided with a vertical aperture or opening 62 for vertical adjustment of the horizontal link 46. A fastening bolt 64 FIG. 2B extends through main frame 48 and aperture 62. A vertically disposed adjusting bolt 66 extending through an inboard tang 68 on link 46 permits the arcuate "tilt" movement (as seen in dotted outline) of the module 10 to be readily adjusted and fixedly set.

As seen in FIG. 2B movement of lever arm 52 leftwardly removes the nylon roller 54 from the enlarged radius 58 causing the module 10 to pivot about right-hand rail member 38. This movement causes the left radial foot member 42 to move arcuately downwardly bringing the radius 43 into engagement with the left-hand guide rail 36 moving the module 10 from the full to the dotted line position shown at left in FIG. 2B. For sliding movement of module 10 in and out the photo copier drum area the forward ends of guide shafts 36 and 38 are tapped and threaded to receive horizontal guide rail extensions (not shown). This enables the operator to conveniently service and/or replace the modular assembly 10 at will. Screw 64 locks the adjustment into the position determined by adjusting bolt 66.

Secured in a fixed position between the two upper side plates 32—32 are slide bars 70, (see top FIG. 2A) that run from the front to the back side plate. A cylindrical, elongated, cartridge member 72 is slideably movable into and out of the replenisher unit 13 by sliding along the bars, 70. Toner powder 12 is contained in cartridge 72 for easy replacement by the operator without the spillage, dust or "hands on mess" ordinarily associated with such materials. Cartridge 72 with toner is inserted into the replenisher unit and is turned 180°. This causes the toner to dump out of the cartridge and also locks the cartridge in place. A pair of angled confronting chute members 74 and 76 permit the toner 12 to move and fall from the cartridge by gravity downwardly toward the toner replenisher shaft, 78. By means of circuitry, as described in conjunction with FIG. 8 a detected change in inductance of the developer is used to activate the toner replenisher-incrementer which in turn moves the toner replenisher roller, 78, and thereby dumps toner into the developer mix, 81 therebelow (FIG. 2B). The exact number of incremental "dumps" of toner added to the "mix" is constantly monitored so as to keep the toner concentration at a predesired level.

The elongated, axially fluted, replenisher roller 78 is positioned at the opening 80 between the confronting edges of chutes 74 and 76. Oppositely disposed flexible flaps 82 secured to each chute edge guide the toner mix 12 into each flute 84 of roller 78 as member 78 is cyclically, incrementally rotated by means to be described shortly herein. So as to prevent the fresh toner mix 12 from compacting into a mass within the area above the angled chutes 74–76 an incrementally rotatable, rectangularly mounted spring member 86 is rotatably disposed within the mix dump area adjacent to and below the cartridge member 72. Member 86 is conjointly rotatable with fluted roller 78 by means to be described herein shortly.

Figures 3, 3A, 3B:
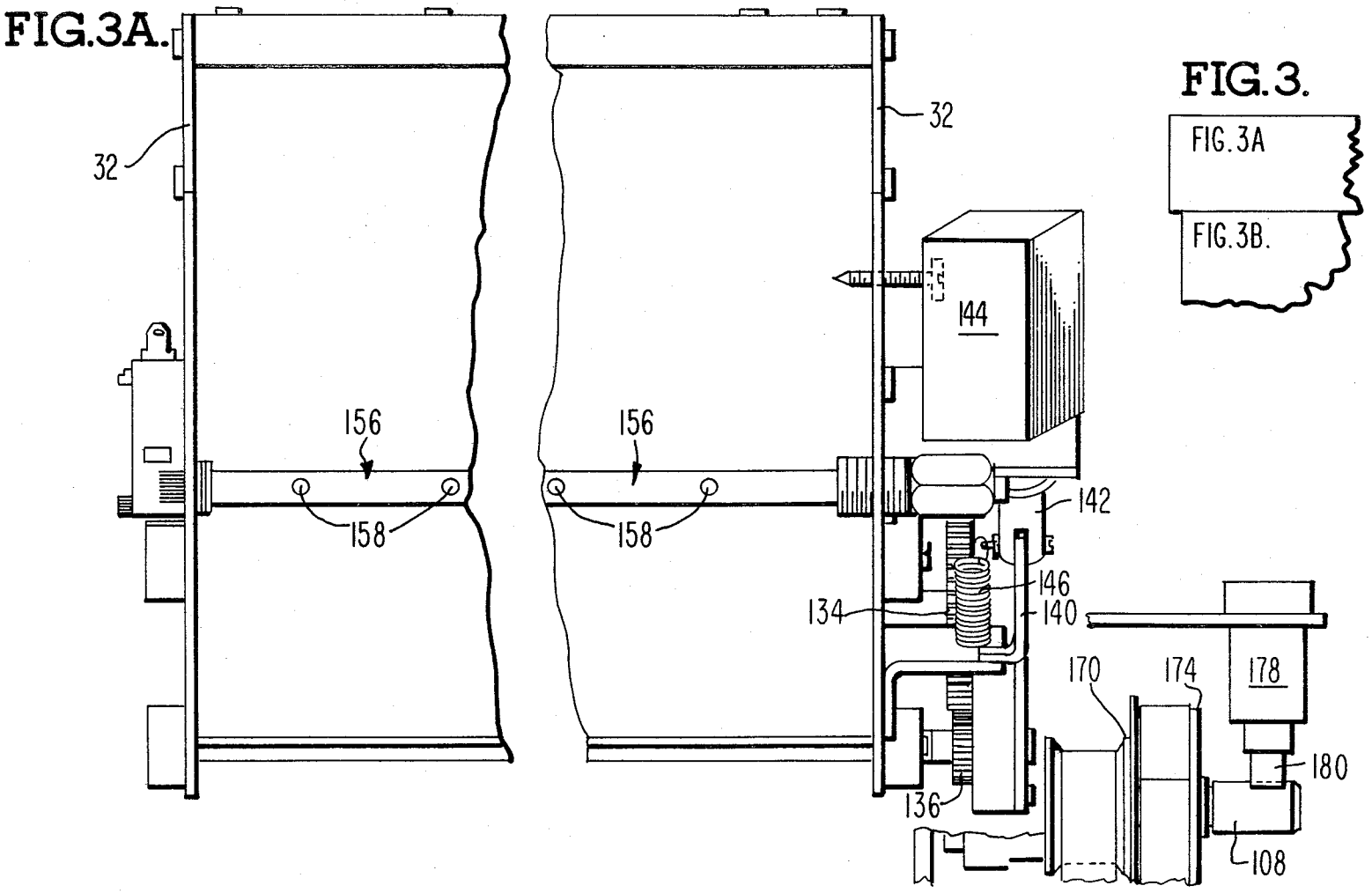
FIG. 3 is a chart showing how
FIGS. 3A and 3B are to be joined to provide a front elevational view of the toner incrementor-replenisher mechanism.
Figure 3B:
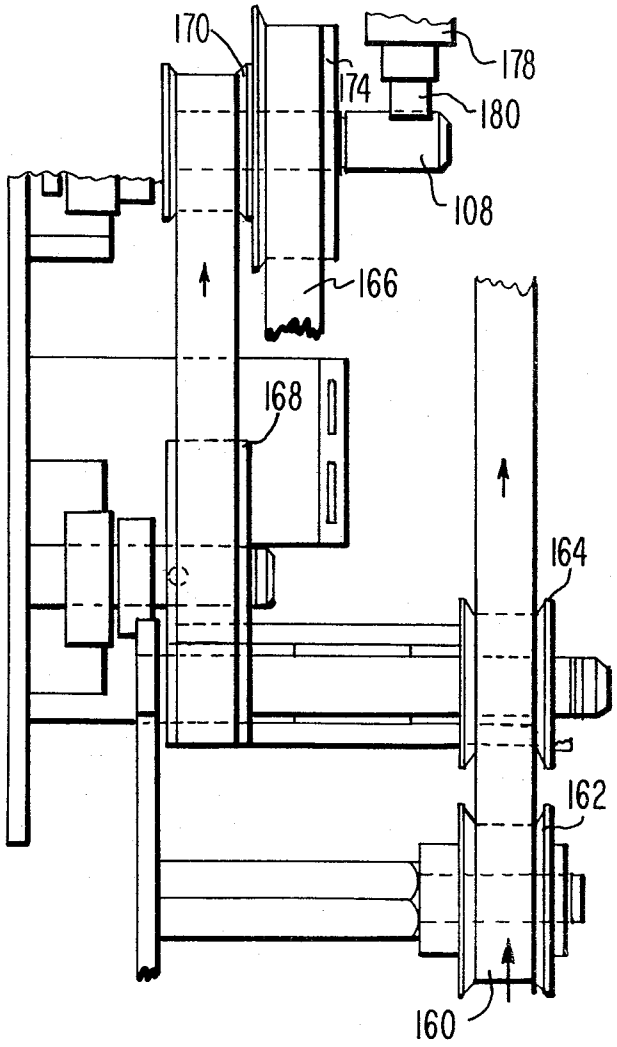
Figure 3B:
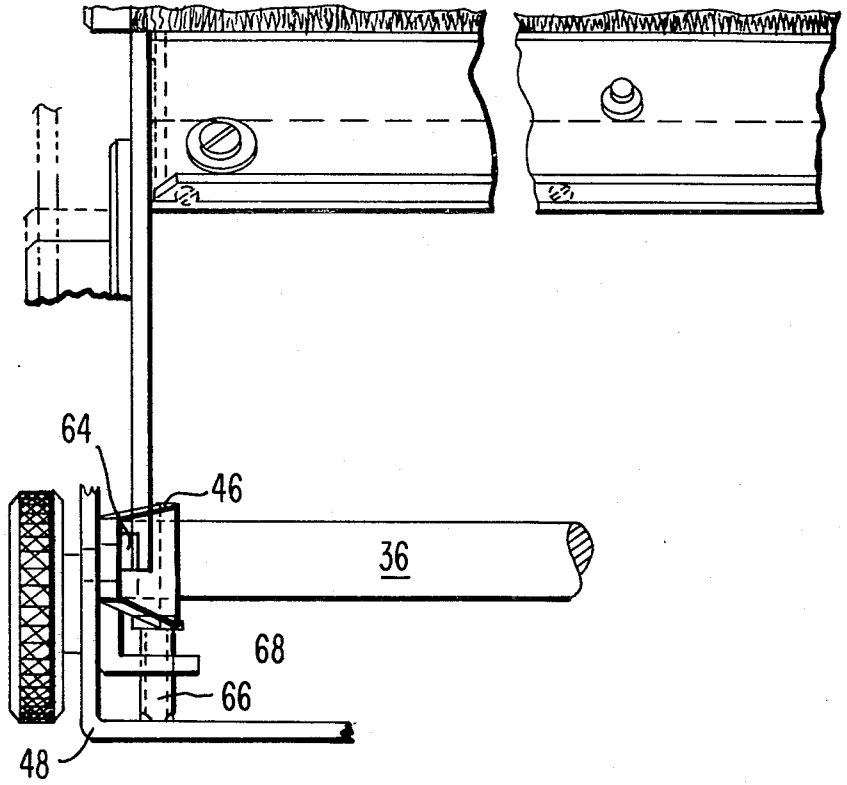
Figure 4:
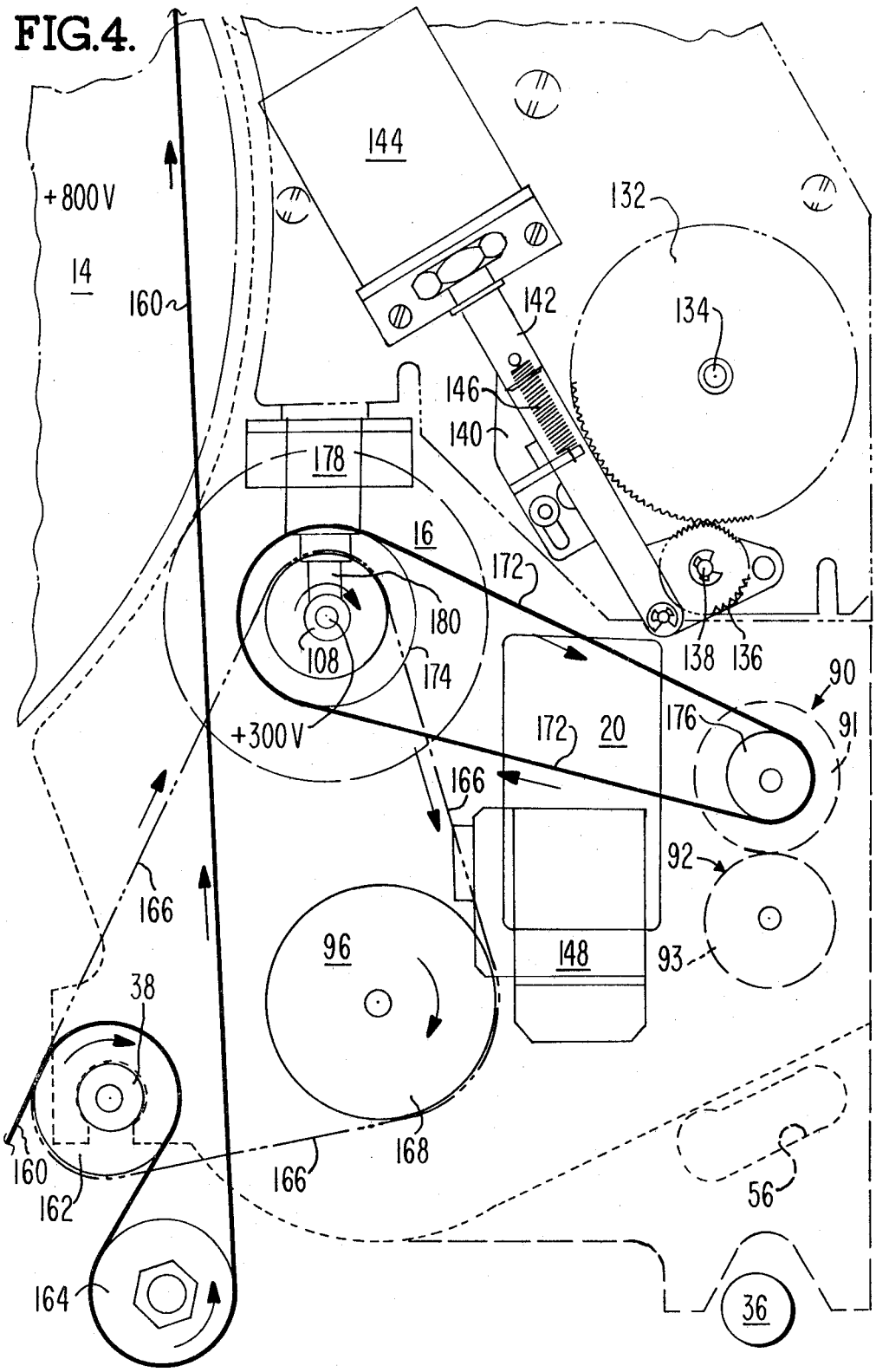
FIG. 4 is a rear elevational view of the toner incrementor-replenisher and drive.

A toner mixing station 88, as seen in FIG. 2B, includes upper and lower wide spaced helical augers 90 and 92 respectively, adapted to rotate in opposite directions relative to each other and to be driven from the main drive FIGS. 3A and 3B through rear mounted intermeshing gears 91 and 93 (FIG. 4). The contra-rotating augers keep the mix 81 flowing evenly across the entire area of the developer mixer module.

A rotatable axially elongated paddle wheel 96 provided with a plurality of elongated, flat, rigid blades or paddles 98 is disposed on a driven cross shaft 100 and journaled in bearings at opposite ends in lower side plates 34—34 (see FIG. 2B). The drive for this and associated hardware will be described later on herein. A developer containment extrusion 102 surrounds the lower portion of paddle wheel 96 and acts to prevent the escape or migration of developer mix 81 beyond the edges of the paddle wheel.

Figure 7:
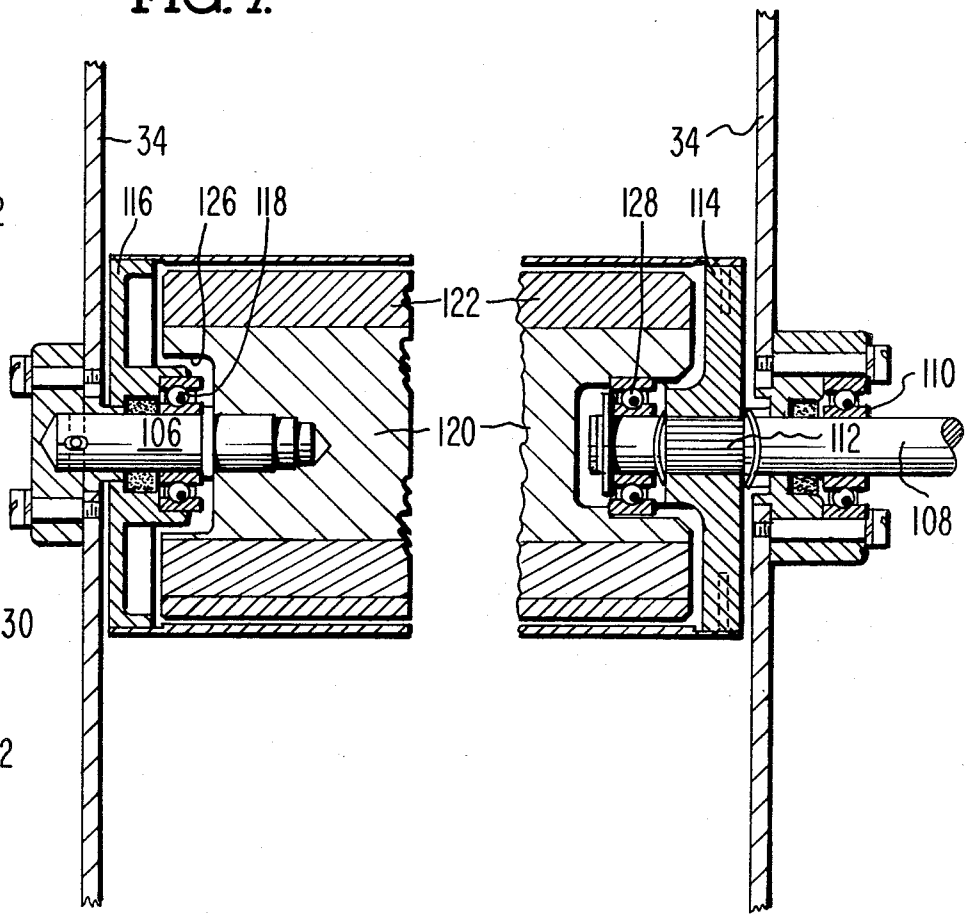
FIG. 7 is a sectional, front elevational view of the magnet arrangement inside the magnetic brush or applicator roller.

Inside the developer mixing station 88 and positioned above and slightly offset to the right of the paddle wheel 96 is a rotatable developer applicator (magnetic brush) roller 104. Roller support stub shaft 106, as seen in FIG. 7, is fixed by a pin at one end to the side plate 34. The opposite support drive shaft 108 is journaled externally of side plate 34 in bearings 110 bolted to the side plate. The inboard end of drive shaft 108 is splined, as at 112, to the end bell 114 of roller drum 104. The opposite end bell 116 of drum 104 is journaled in bearings 118 on stub shaft 106. This arrangement permits the drum 104 to be rotated while the shaft 106 remains fixed in position, for purposes described hereinafter.

Internally of drum 104 is disposed a fixed iron magnet carrier/member 120. Four angularly disposed, elongated, bar, ceramic magnets 122 are secured along flats 124 (FIGS. 2A and 2B) milled or otherwise formed in member 120. The support member 120 is undercut at each end, as at 126 so as to provide clearance for the respective end bearings 118 and 128 as shown in FIG. 7.

The magnetic brush roller 104 is provided with a rough exterior surface which in this embodiment takes the form of elongated, axial grooves 130 whose spacing is nearly the same as the length of the individual brush strands built up in developer mix 12 and carried on the roll 104 on as the roll 104 is rotated over the stationary magnet quartet.

As the toner is "used up" or depleted due to the copy production output of the printing apparatus it is necessary to replenish the mix so as to avoid a complete "run out" of the toner during the operation of the printer. A large gear 132, FIG. 4, on the rear of cross shaft 134 carrying flipper spring 86 is engaged by a rachet wheel 136 (attached to the drive shaft 138 and fluted roller 78) FIG. 2A. Ratchet wheel 136 is driven by a vertical link 140, which is moved up and down on signal demand by the pole piece 142 of solenoid 144. A return spring 146 biases the solenoid link 138 into the inoperative position.

Located approximately at the center, slightly above and to the left of the paddle wheel 96 adjacent to the drum 14 is the concentration sensor chute assembly mechanism 20. This mechanism includes an irregularly shaped hollow, cylindrical, member, rectangular at the top and angularly truncated at the bottom. Both the top and bottom of member 20 is open. A close-wound inductor in the form of a fine wire toner sensing coil 30 is potted into the assembly which is molded from suitable plastic material for light weight and ease of construction. A solenoid 148, FIGS. 5 and 6 secured in a horizontal position to the side plate 34 has its core member 150 projecting outwardly into a slight recess in the side plate 34 so that when energized the magnetic field 152 crosses into the downwardly angled portion of the sensor chute 20.

Angled downwardly to the left in FIG. 2A, is a rigid flat, elongated doctor blade 18, the upper end of which projects within a few ten thousandths of an inch from member 104 but does not in fact touch drum 104. The member 18 is provided with an aperture 154 located directly over the upper opening of the sensor chute 20, as seen in FIG. 2A and FIG. 1. Rotation of drum 104 will cause a certain amount of toner mix 12 to be doctored off the drum 104 and down into chute 20.

A signal applied to the solenoid 148 from the software control system (FIG. 8) will cause te generation of the magnetic field 152 around the end of core 150 compacting the developer mix 81 and creating a blocking restriction of the mix within the portion of the chute adjacent to the core 150. As the developer mix 81 fills up the chute the excess developer simply spills out over the side of the chute mechanism and falls by gravity back down onto the dual auger mechanism 90–92 to be recirculated or pushed up and circulated across the drum again by the paddle wheel 96 and drum 104.

As seen in FIG. 3A a negative air line (suction) 156 incuding at least four separate inlet openings 158 is provided in order to suck out any excess toner mix which might be in the ambient air adjacent to the toner input hopper.

Drive means for rotating and moving portions of the present invention is seen by reference to FIGS. 3A, 3B and 4, to include a main drive belt 160 driven by an electric motor (not shown). Drive belt 160 is fed over the top of pulley 162 thence down and around pulley 164 and upwardly to rotate other portions of the printer-copier apparatus (not shown). A first toothed non-slip drive belt 166 takes rotative force from pulley 162 to drive paddle wheel 96 via large pulley 168 and pulley 170 driving magnetic brush 16. A second toothed, non-slip drive belt 172 interconnecting large pulley 174 and smaller pulley 176, transmits rotative torque to the intermeshed gears 91 and 93 driving the auger members 90 and 92.

Secured above shaft extension of magnetic brus drive shaft 108 (FIG. 7) is a carbon brush holder 178 supporting a carbon brush 180. An electrical potential of plus 300 volts is applied to shaft 108 during operation of the printer/copier apparatus. This potential is applied to the rotating outer shell of 104 to prevent toner from being drawn from the developer mix to the copier drum 14 in the discharged or background arear.

As seen in FIG. 8, the toner sensor coil 30 is incorporated into a series resonant circuit 182 the latter comprising resistors 184—184 and capacitors 186—186 and coil 30. 10 $R_{Hz}$ reference oscillator 188 generates a sine wave output signal 190 of which is applied to coil 30 and to the input of wave shaper 192. The output from the $10k_{Hz}$ resonant circuit 182 is applied across a resistive divider 194 (which lowers the amplitude of the signal) to the input level of wave shaper 196. Wave shaper 196 takes the output signal from the top of coil 30 (a sinusoidal wave) wich is approximately 90° phase shifted from the sine wave 190 from reference oscillator 188 and squares this signal to produce an output square wave 198 of the same phase. Signal 198 is applied to the lower input of exclusive "or" circuit 200. The pulse width of output pulse 204 of exclusive "or" circuit 200 varies as a function of toner concentration (in toner sensor chute 20) as detected by coil 30. Thus, the exclusive "or" ckt 200 produces a signal whose pulse length is proportional to the phase change off resonance within the sensor coil 30. Pulse 204 is fed to the gate of counter 206 having a high frequency clock input.

The counter 206 output from the high frequency clock is fed to a hex code generator 208 which converts the hexidecimal code from the counter 206 into the hex code used by the operably associated micro-processor 210. By means of a built-in look-up table the micro-processor 210 compares the hexidecimal number (count) with a reference number within the micro-processor to produce a signal for application to the toner incrementer solenoid 144 to cause additional toner to be applied to the toner mix.

The micro-processor 210 includes a timer which causes the cycle of operation to repeat at 20 second intervals. During the first portion of the cycle the micro-processor feeds a signal to the solenoid coil 22 of solenoid 26 which for five seconds immobilizes the toner mix within the chute member 20, as hereinbefore described. At this point while holding the coil 22 energized for five seconds the micro-processor takes a reading of the hex code coming from the counter 206. The comparison between the derived hex code from the toner sensor coil 30 and the reference hex code of the micro-processor develops a pulse count for application to the solenoid 144. After five seconds the solenoid is released and the toner dumps in the original mix.

For example, if the hex count after comparison is off by one count the solenoid 144 receives three pulses. If the hex count is off by two counts the solenoid receives six pulses. Three counts gives nine pulses while four counts off produces twelve pulses. Each pulse or "click" of solenoid and escapement 136–144 causes the toner replenisher incrementer roler 80 to dump a fresh portion of toner into the auger area therebelow for toner replenishment. If, on the other hand, the toner concentration is too high the original mix is continued in use until such time as additional toner is required.

A related application is U.S. Ser. No. 496,156 filed May 19, 1983 entitled "DIGITAL IMPLEMENTATION OF TONER CONCENTRATION SENSING APPARATUS" in the name of William M. Koos, Jr. assigned to the same assigner as the present invention.

The aforedescribed mechanism is incorporated within the structure of the printer/copier such that its operation is automatic, i.e. controlled by the software of the base operating hardware (not shown) and except for loading a fresh cartridge of toner within the assembly, in the normal course, the concentration of toner is automatically maintained at a suitable level for dense, black, clean, crisp, clear, sharp printing without further attention from an operator.

The present invention among other advantages eliminates the problems caused by turbulance or motion of the mix as it moves into and within the toner concentration sensor. Such turbulence causes variations in the sensor signal output resulting in incorrect amounts of toner being added to the mix. In the present arrangement the sensing coil is displaced from the mix itself and is positioned outside (rather than inside) and above the mix proper. In addition, the developer flow is stopped and the measurement is performed while the mix is stationary. The resulting output signal is thus clean and accurate.

What is claimed is:

1. A toner developer concentration sensor assembly for an electrophotographic printing/copying apparatus comprising:

demountable, removable, replaceable electrophotographic toner cartridge means for renewing the concentration of toner in developer mix used in said apparatus;

means through which said used developer is automatically moved for determining the concentration of toner in said used developer mix;

means for immobilizing said used developer within said concentration determining means;

inductive means surrounding said concentration determining means for indicating the change in permeability of said used developer mix when and thus the immobilized toner concentration of said mix as compared to a preset level of concentration; and means operably connected to said inductive means for automatically, incrementally adding toner to said used developer mix in accordance with the indicated change in toner concentration of said used developer mix.

2. The sensor assembly in accordance with claim 1 wherein said concentration determining means further comprises a chute-like member for receiving a portion of said used developer disposed in the path of movement of said used developer but physically positioned out of the developer mixing area of said apparatus effectively avoiding interaction with the moving mass of developer mix.

3. The sensor assembly in accordance with claim 1 wherein said immobilizing means further includes electromagnetic means having field concentrating means disposed adjacent said inductive means effective to concentrate the magnetic lines of force of said field within said used developer mix so as to momentarily coagulate the mix within said concentration determining means.

4. The sensor assembly in accordance with claim 1 wherein said inductive means comprises a coil surrounding said concentration determining means and wherein said coil is physically separated from said immobilizing means to prevent interaction therebetween.

5. The sensor assembly in accordance with claim 1 further including means adjacent said toner cartridge for agitating the toner decanted from said cartridge and further including means for metering fresh toner into said developer mix in response to an indicated change in concentration.

6. The sensor assembly in accordance with claim 1 further including confronting rotatable means for agitating said developer mix so as to uniformly charge the mix prior to toning and developing an image.

7. The sensor assembly in accordance with claim 1 further including magnetic means for creating a uniform distribution and flow pattern of the developer mix for application to the electro-photographic means of said printing/copying apparatus.

8. The sensor assembly in accordance with claim 1 wherein said toner developer concentration sensor assembly is part of a larger developer unit which is slideably removable from said printing/copying apparatus, and wherein said developer unit can be moved angularly toward and away from the electrophotographic means of said apparatus for service, cleaning and repair.

* * * * *